United States Patent [19]

Liley

[11] Patent Number: 4,586,052

[45] Date of Patent: Apr. 29, 1986

[54] MOUNTING SYSTEM FOR ANTENNA FOR POP-TOP CAMPING TRAILERS

[76] Inventor: Chester G. Liley, 17108 Southport Dr., Holly, Mich. 48442

[21] Appl. No.: 715,667

[22] Filed: Mar. 25, 1985

[51] Int. Cl.[4] ..... H01Q 1/32

[52] U.S. Cl. ..... 343/713; 52/110; 52/116; 52/29

[58] Field of Search ..... 52/27, 29, 32, 40, 110, 52/111, 116, 117, 118; 248/291, 514, 534, 539; 343/709, 710, 713, 715, 880, 881, 882, 892

[56] References Cited

U.S. PATENT DOCUMENTS

| | | | |
|---|---|---|---|
| 2,689,549 | 9/1954 | Hayman | 52/117 |
| 3,134,978 | 5/1964 | Arvay | 343/709 |
| 3,208,703 | 8/1965 | Arnold et al. | 248/514 |
| 4,500,064 | 2/1985 | Calabro | 248/539 |

FOREIGN PATENT DOCUMENTS

| | | | |
|---|---|---|---|
| 206089 | 4/1955 | Australia | 248/514 |

*Primary Examiner*—Henry E. Raduazo
*Assistant Examiner*—John M. White
*Attorney, Agent, or Firm*—Harry R. Dumont

[57] ABSTRACT

A pivotal mounting plate for a foldable T. V. antenna. The mounting is designed to be mounted on one side, generally the left hand side of the hard shell top of the camper. It is designed to stand vertically erect with the antenna mounted on it unfolded to render it operative. The mounting plate is pivotal to a horizontal position and latched over a stud or bolt in a carrying and inoperative condition. At this time, the antenna is telescoped and retained in a folded position.

5 Claims, 3 Drawing Figures

MOUNTING SYSTEM FOR ANTENNA FOR POP-TOP CAMPING TRAILERS

BACKGROUND OF THE INVENTION

Pop-top campers present some problem with respect to mounting aerials on them. The front and rear as well as the sides of the camper are of a soft and foldable material such as canvas or vinyl so that the surfaces that are rigid and capable of bearing an antenna are limited. The present invention relates to a mounting system and mounting plate for T.V. antennas. The mounting plate is fixed to the hard shell top in such a manner that it does not interfere with the opening and closing of the camper. In the folded position of the antenna, it is carried so as to offer a minimum obstruction to air flow during travel.

A number of prior art antenna mounting means are known that are adapted to be carried on moving vehicles. One type of antenna holder is shown in U.S. Pat. No. 3,191,898 issued on June 29, 1965 to R. C. McCullough for "Adjustable Antenna Mounting." This antenna is adjustable manually between several positions but requires a relatively complicated pair of bias springs and associated mechanism for securing the antenna in the desired position.

U.S. Pat. No. 3,357,663 issued on Dec. 12, 1967 to L. H. Ivy for "Antenna Support Clamp Assembly" shows a still further arrangement of a antenna clamp assembly used on boats. The latch again is relatively complex and includes adjustable friction means and latch means.

A still further type of antenna mount is showed in U.S. Pat. No. 3,521,285 issued on July 21, 1970 to E. J. Mautner for "Antenna Mount." Like most of the prior art, the antenna mount base is adapted for fitting on an available horizontal surface. The mount for the bulk head includes an s-shaped member for allowing different adjustments for the antenna.

SUMMARY OF THE INVENTION

The present invention comprises a mounting plate for a foldable antenna that is adapted to register alongside a limited side surface of a pop-top camper and to store almost flush with the side of the hard molded top where it will not interfere with the raising or lowering of the top.

BRIEF DESCRIPTION OF THE INVENTION

The present invention will now be described with reference to the accompanying specification and the drawings in which like numerals are used to refer to like parts as they may appear in the several different views and, in which.

DETAILED DESCRIPTION OF THE PREFERRED EMBODIMENT

Figure 1:
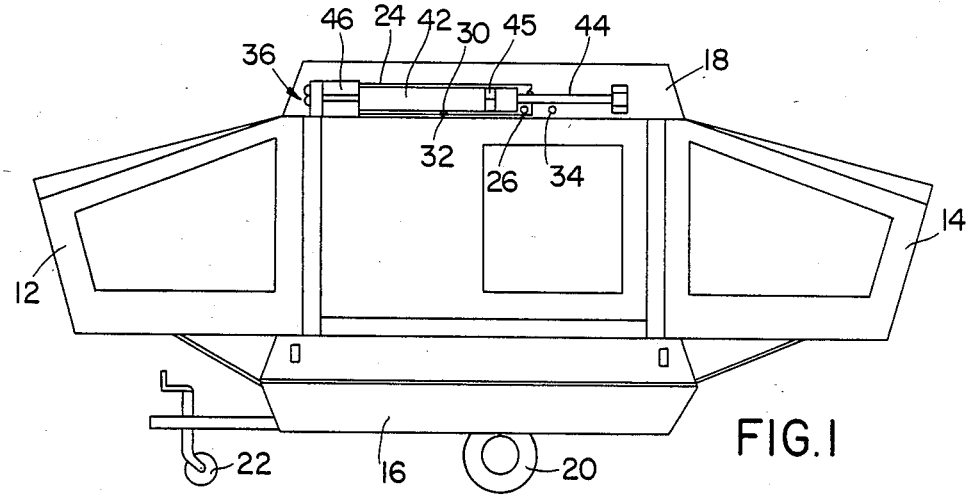
FIG. 1 is a side elevational view of the pop-top camper with antenna mounting plate and antenna in their horizontal position.

FIG. 1 shows a pop-top camper 10 in its elevated top position. The pop-top camper 10 includes a folding front portion 12 and a folding rear portion 14. The bed of the camper is indicated by the numeral 16 and includes an elevating mechanism of the mechanical type used to raise the camper to its upper position. Also included in the camper 10 is a hard shell cap 18 which forms the roof of the camper in a raised position and rests on the lower trailer bed 16 in the closed position to provide a compact and secure arrangement for transporting the trailer and goods.

Also included in the trailer 10 is a pair of wheels 20, one of which is shown, and a forward jacking wheel 22. A problem exists with respect to mounting a T.V. antenna on the trailer since there is a very limited surface on which secure mounting can be provided. It is also necessary that the antenna mounting system be storable in such manner that it does not interfere with the raising and lowering of the cap 18.

Figure 2:
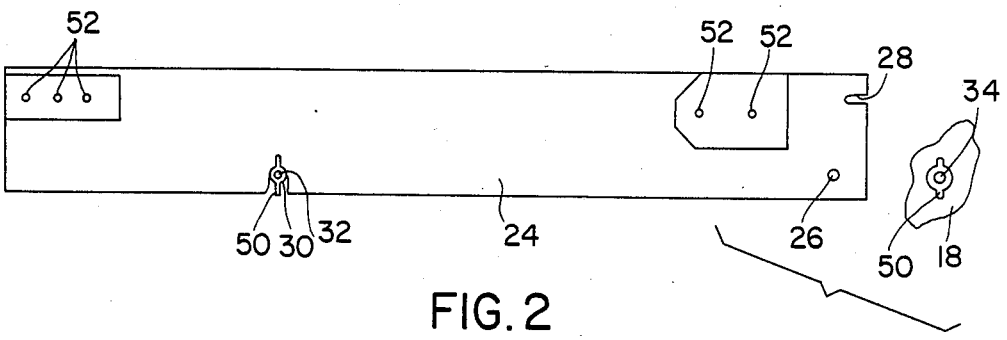
FIG. 2 is a side elevational view to enlarged scale showing the mounting plate for the antenna.

The basic element used for mounting the antenna is a mounting plate 24 best shown in FIGS. 1 and 2. The mounting plate 24 is pivotably mounted on the cap 18 on a stud 26 that extends outwardly in a sideward direction from the cap 18. A pair of notches are formed in the mounting plate 24. The first notch portion at the right-hand end of the mounting plate 24 and is identified by the numeral 28. The second notch portion 30 is formed in the lower edge of the mounting plate 24. A pair of studs are mounted on the cap 18 and extend outwardly therefrom. The first of these studs is identified as stud 32 and lies in the path of the notch 30 formed in the mounting plate 24. A second stud 34 extends outwardly from the hard shell cap 18 and lies in the radial path of the notch 28 as the mounting plate 24 is rotated to a vertical position fitting about the stud 26. The position shown in FIG. 1 is the horizontal position of the antenna 36. The antenna 36 includes a plurality of a loops 38 that are pivotably attached at point 40 at the upper-end of a tube 42. The barrel 42 is movable upwardly or downwardly and journaled about a central rod 44 to central the length of the antenna in its operative condition. The loops 38 telescope in the tube 42 when it is not extended. A band clamp 46 is fixed to the plate 24 near its left hand end. The barrel 42 slides in band clamp 46 if full extension is needed. A scissor clamp 45 is further included to hold the right hand end of the barrel 42 on the mounting plate 24.

The folded down position of the antenna 36 and the loops 38 is shown in FIG. 1. In the folded condition of the antenna, the notch portion 30 of the mounting plate 24 is fitted downwardly over stud 32.

Figure 3:
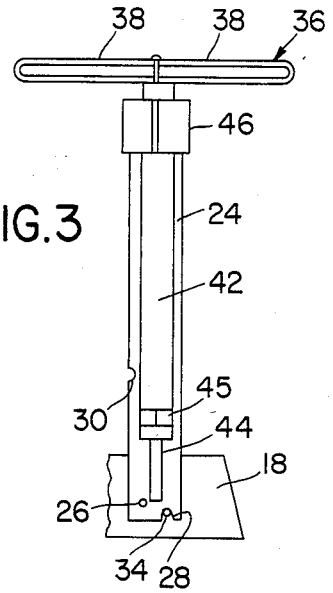
FIG. 3 is a fragmentary view showing the mounting plate and the antenna in their upright position.

In the upright position of the antenna 36 and the mounting plate 24 as shown in FIG. 3, the notch portion 28 of the mounting plate 24 is fitted over the stud 34, extending outwardly from the cap 18. A plurality of wing nuts 50 are included as shown in FIG. 2 for fitting over the studs 32, 34 respectively and for securely latching the mounting plate 24 either in its horizontal stored position or in its alternate upright operating position. Also included in the mounting plate 24, as best shown in FIG. 2 there are formed a plurality of bolt holes 52 for mounting the barrel clamp 46 and the scissors clamp 45, respectively to the mounting plate 24.

It will thus be seen that I have provided by my invention an improved mounting system for antennas that is particularly adaptable for use with pop-top campers and other similar vehicles in which there is a limited amount of rigid superstructure to which an aerial can be attached. The present invention also involves a system for mounting aerials so that they are readily movable between a stored position and an operative position and securely held in either position.

I claim:

1. An antenna mounting system for a pop-top trailer having a rigid cap, comprising;

a mounting plate for the antenna;

means for mounting said plate pivotally on one side of the cap;

an end notch portion formed in one end of the plate;

a side notch portion formed in the lower side of side plate;

and a first stud mounted on and extending from said side of the cap and located in a radial path with said end notch portion for engaging it and thus holding the mounting plate and the antenna in an upright position;

said side notch portion engagable with a second stud fixed to said cap and extending outwardly from said cap side in the down position of the mounting plate and the antenna;

and means for fastening said antenna to said mounting plate.

2. The combination as set forth in claim 1 in which there is included a wing nut threadably engageable with said second stud for detachably holding said mounting plate and said antenna in their down position.

3. The combination as set forth in claim 1 in which there is included a wing nut threadably engageable with said first stud for latching the locking plate and the antenna in their upright position.

4. The combination as set forth in claim 1 in which said antenna is of the foldable type including a tubular end.

5. The combination as set forth in claim 1 in which said last mentioned means comprises a plurality of bolt fasteners connected to said mounting plate for mounting said antenna on said mounting plate.

* * * * *